US009684273B2

(12) United States Patent
Yagi et al.

(10) Patent No.: US 9,684,273 B2
(45) Date of Patent: Jun. 20, 2017

(54) APPARATUS THAT FORMS AN IMAGE ON A MEDIUM USING A PLURALITY OF ERASABLE MATERIALS AND ERASING APPARATUS

(71) Applicants: KABUSHIKI KAISHA TOSHIBA, Tokyo (JP); TOSHIBA TEC KABUSHIKI KAISHA, Tokyo (JP)

(72) Inventors: Norifumi Yagi, Tokyo (JP); Takao Ishida, Kanagawa (JP); Kanya Hiroi, Kanagawa (JP); Mamoru Nomura, Tokyo (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/249,194

(22) Filed: Aug. 26, 2016

(65) Prior Publication Data

US 2016/0363902 A1 Dec. 15, 2016

Related U.S. Application Data

(60) Continuation of application No. 14/850,215, filed on Sep. 10, 2015, now Pat. No. 9,481,193, which is a division of application No. 13/964,926, filed on Aug. 12, 2013, now Pat. No. 9,158,252.

(51) Int. Cl.
*G03G 15/00* (2006.01)
*B41M 7/00* (2006.01)

(52) U.S. Cl.
CPC ..... *G03G 15/6585* (2013.01); *B41M 7/0009* (2013.01); *G03G 15/50* (2013.01)

(58) Field of Classification Search
CPC . G03G 15/50; G03G 15/6585; B41M 7/0009; G06F 3/1257
See application file for complete search history.

(56) References Cited

U.S. PATENT DOCUMENTS

| | | | |
|---|---|---|---|
| 5,394,231 | A | 2/1995 | Sudo et al. |
| 5,534,907 | A | 7/1996 | Tsutsui et al. |
| 5,585,320 | A | 12/1996 | Tsutsui et al. |
| 6,596,669 | B1 | 7/2003 | Maruyama et al. |
| 8,260,188 | B2 | 9/2012 | Yahata et al. |
| 2006/0088350 | A1 | 4/2006 | Imamiya |
| 2006/0115283 | A1 | 6/2006 | Yamauchi et al. |
| 2006/0269328 | A1 | 11/2006 | Ochiai |
| 2009/0153921 | A1 | 6/2009 | Maeyama |
| 2009/0154970 | A1 | 6/2009 | Yoshida et al. |
| 2010/0118349 | A1 | 5/2010 | Ozawa |
| 2010/0209129 | A1 | 8/2010 | Kaneko et al. |
| 2010/0272449 | A1 | 10/2010 | Yoshida et al. |

(Continued)

*Primary Examiner* — David Bolduc
(74) *Attorney, Agent, or Firm* — Patterson & Sheridan, LLP

(57) ABSTRACT

An image forming apparatus according to an embodiment comprises a first image forming section configured to form an image on a recording medium with a non-erasable material, and a second image forming section configured to form an image on the recording medium with an erasable material. The image forming apparatus further comprises a control section configured to separate image data according to attributes of the image data into first image data to be printed on the recording medium in the first image forming section and second image data to be printed on the recording medium in the second image forming section.

12 Claims, 11 Drawing Sheets

(56) References Cited

U.S. PATENT DOCUMENTS

| | | | |
|---|---|---|---|
| 2010/0290812 | A1 | 11/2010 | Taguchi et al. |
| 2011/0033216 | A1 | 2/2011 | Taki et al. |
| 2011/0199625 | A1 | 8/2011 | Sugimoto et al. |
| 2011/0212397 | A1 | 9/2011 | Aoki et al. |
| 2011/0262197 | A1 | 10/2011 | Imamiya et al. |
| 2011/0304881 | A1 | 12/2011 | Saitou |
| 2012/0038941 | A1 | 2/2012 | Megawa |
| 2012/0092713 | A1 | 4/2012 | Hagiwara |
| 2012/0141154 | A1 | 6/2012 | Yoshida |
| 2012/0170064 | A1 | 7/2012 | Hibino et al. |
| 2012/0257264 | A1 | 10/2012 | Megawa |
| 2012/0275803 | A1 | 11/2012 | Taguchi et al. |
| 2012/0321335 | A1 | 12/2012 | Fujiwara |
| 2012/0321350 | A1 | 12/2012 | Ogasawara |
| 2012/0327154 | A1 | 12/2012 | Mimura |
| 2012/0327487 | A1 | 12/2012 | Kamisuwa et al. |
| 2013/0002785 | A1 | 1/2013 | Taguchi |
| 2013/0003134 | A1 | 1/2013 | Hazu et al. |
| 2013/0016375 | A1 | 1/2013 | Hashidume et al. |
| 2013/0016376 | A1 | 1/2013 | Hashidume et al. |
| 2013/0045020 | A1 | 2/2013 | Kaneko et al. |
| 2013/0070305 | A1 | 3/2013 | Tomizawa et al. |
| 2013/0077982 | A1 | 3/2013 | Hasegawa et al. |
| 2013/0077983 | A1 | 3/2013 | Kashiwagi |
| 2013/0156458 | A1 | 6/2013 | Suzuki |
| 2013/0236196 | A1 | 9/2013 | Shinohara |
| 2013/0258379 | A1 | 10/2013 | Yoshida et al. |
| 2014/0063511 | A1 | 3/2014 | Tomizawa |
| 2014/0193168 | A1 | 7/2014 | Kimoto |
| 2014/0210930 | A1 | 7/2014 | Umetsu |
| 2014/0211265 | A1 | 7/2014 | Phillips et al. |
| 2014/0212157 | A1 | 7/2014 | Ishikawa |
| 2014/0212160 | A1 | 7/2014 | Fukaya |

APPARATUS THAT FORMS AN IMAGE ON A MEDIUM USING A PLURALITY OF ERASABLE MATERIALS AND ERASING APPARATUS

CROSS-REFERENCE TO RELATED APPLICATIONS

This application is a continuation of U.S. patent application Ser. No. 14/850,215, filed on Sep. 10, 2015, which is a division of U.S. patent application Ser. No. 13/964,926, filed on Aug. 12, 2013, now U.S. Pat. No. 9,158,252, issued on Oct. 13, 2015. Also, U.S. patent application Ser. No. 15/004,857 was filed on Jan. 22, 2016, as another continuation of the division. The entire contents of each of these applications are incorporated herein by reference.

FIELD

Embodiments described herein relate to an image forming apparatus and method for forming an image with erasable and non-erasable material.

BACKGROUND

Image forming apparatuses for forming an image on a recording medium include an apparatus which comprises an image forming section using non-erasable toner and an image forming section using erasable toner in the same housing. On the other hand, the created image data is divided into a main body part and an additional part which are printed in different colors, and the user may desire to erase the color of the additional part later.

DETAILED DESCRIPTION

An image forming apparatus according to an embodiment comprises a first image forming section configured to form an image on a recording medium with a non-erasable material, and a second image forming section configured to form an image on the recording medium with an erasable material. The image forming apparatus further comprises a control section configured to separate image data according to attributes of the image data into first image data to be printed on the recording medium in the first image forming section and second image data to be printed on the recording medium in the second image forming section.

Embodiments are described below.

First Embodiment

Figure 1:
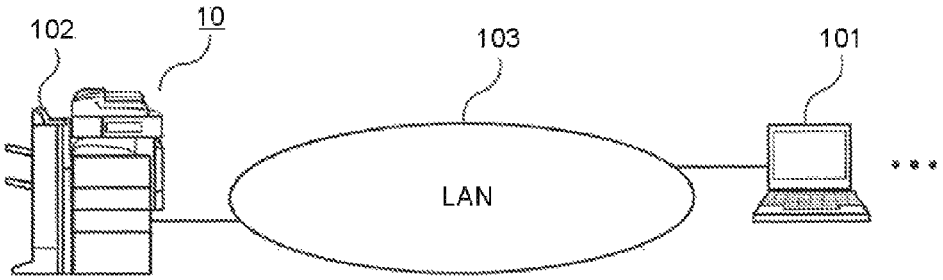
FIG. 1 is a diagram illustrating a data communication system according to a first embodiment.

The image forming apparatus of the first embodiment is described below with reference to accompanying drawings of FIG. 1-9. FIG. 1 illustrates an image forming system 100 according to embodiment 1. The image forming system 100 includes an MFP (Multi-Function Peripheral) 10 serving as an image forming apparatus comprising a PC (Personal Computer) 101 and a finisher 102 as user terminals. No limitation is given to the number or model of the user terminals and the image forming apparatuses. A LAN (Local Area Network) 103 connects the PC 101 with the MFP 10. The MFP 10 is capable of printing the print data, such as the file created by the PC 101, with a non-erasable material and/or an erasable material.

Figure 2:
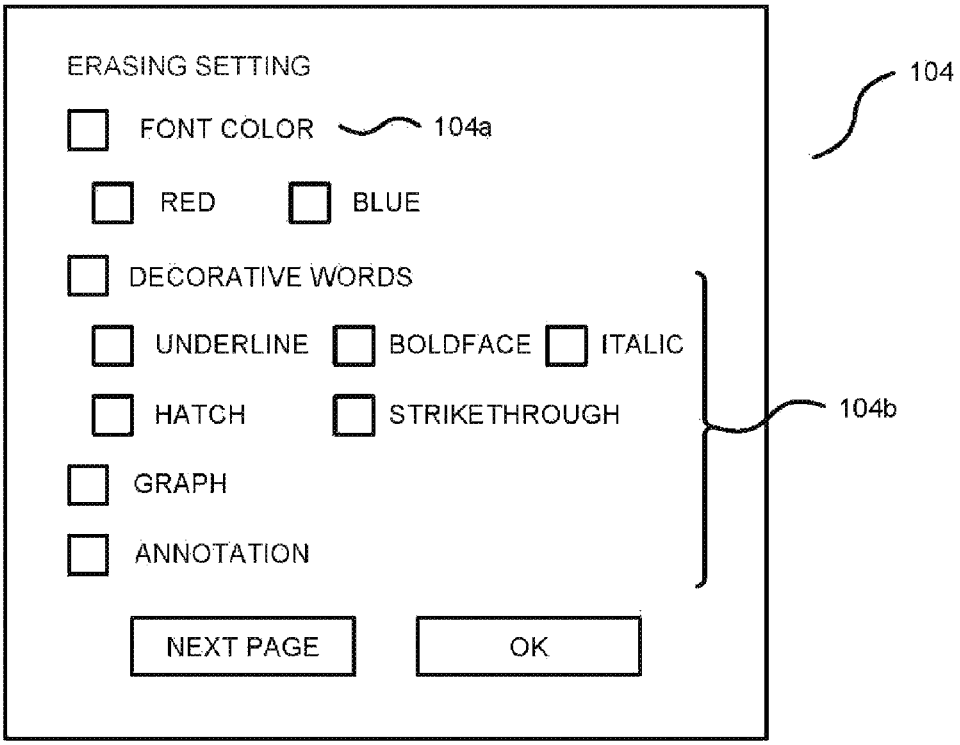
FIG. 2 is a diagram illustrating a printing condition screen of an MFP of a PC, according to the first embodiment.

The PC 101 includes an application for the printing setting of the MFP 10. The printing setting application of the MFP 10 includes a printing condition screen for printing the created print data with an erasable material. For example, as shown in FIG. 2, a color selection condition 104*a* and an image designation condition 104*b* are displayed on the printing condition screen 104 for erasable printing. The creator of the print data or the system manager randomly checks the setting items of the color selection condition 104 and the image designation condition 104*b*, updates the next page if needed, and presets a printing condition of the print data for printing with erasable material.

The color selection condition 104*a* sets, for example, a red color or a blue color. For example, the color selection condition 104*a* is set to analyze the objects of the print data created by the PC and print the print data of which the characters are red or blue using an erasable material. Similarly, the image designation condition 104*b* may set a condition as follows: if the analyzed object is decorative words or a mark representing a graph or an annotation, then the analyzed object is printed with an erasable material. Decorative words include underline, boldface, italic, hatch and strikethrough. Further, the printing condition screen for erasable printing may be displayed on the operation screen of the MFP 10 directly and set using the operation panel of the MFP 10.

Figure 3:
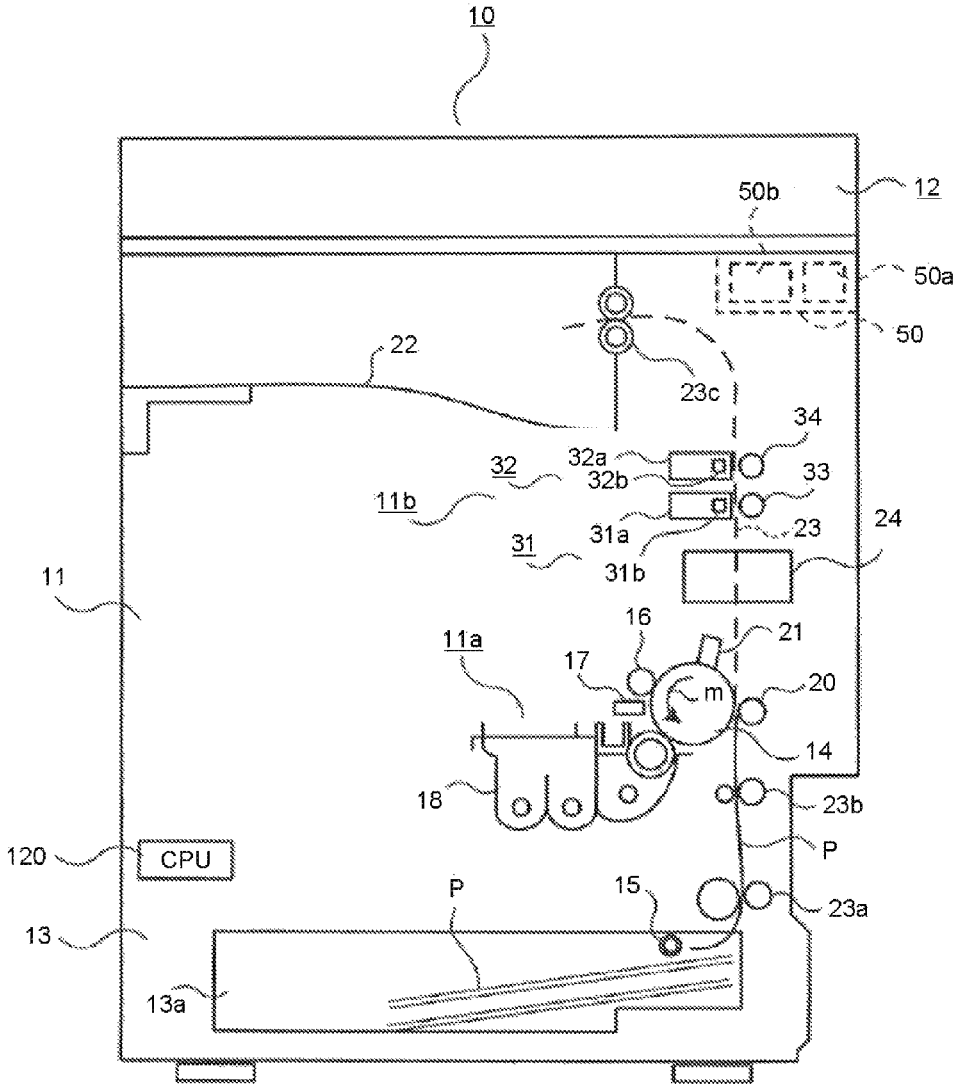
FIG. 3 is a diagram illustrating the MFP, according to the first embodiment.

As shown in FIG. 3, the MFP 10 includes a CPU 120 serving as a control section for controlling the whole MFP 10. The MFP 10 includes a printing mode for forming an image on a sheet P serving as a recording medium and an erasing mode for erasing the image formed on the sheet P. The MFP 10 includes a printer section 11, a scanner section 12, a paper feed section 13 and a paper discharge section 22.

The MFP 10 also includes a control panel 50, which is provided with an operation panel 50*a* and a touch panel type display 50*b*. The operation panel 50*a* accepts an input of, for example, a user. The display 50*b* accepts the input of, for example, a user. The display 50*b* also generates and provides a display for the user.

The paper feed section 13 has a paper feed cassette 13*a* and a paper feed roller 15. The paper feed cassette 13*a* stores the sheet P. In the printing mode, the sheet P stored in the paper feed cassette 13*a* may be either unused sheets or reused sheets (i.e., sheet erased through an erasing processing). In the erasing mode, printed sheet P is stored in the paper feed cassette 13*a*.

The printer section 11 includes a non-erasable printer section 11*a* serving as a first image forming section for forming an image with a non-erasable material and an erasing printer section 11*b* serving as a second image forming section for forming an image with an erasable material. The MFP 10 includes a conveyance path 23 in which sheet P is conveyed to the paper discharge section 22 after passing the non-erasable printer section 11*a* and the erasing printer section 11*b* from the paper feed section 13. The conveyance path 23 is provided with a conveyance roller 23*a*, a register roller 23*b* and a paper discharge roller 23*c*.

The non-erasable printer section 11*a* is, for example, an electrophotographic type printer which forms an image with a non-erasable toner, that is, a non-erasable material which will not be thermally erased. The non-erasable printer section 11*a* is not limited to be an electrophotographic printer. The non-erasable printer section 11*a* includes a charger 16, an exposure scanning head 17, a developer 18 and a cleaner 21 around a photoconductive drum 14 rotating in the direction indicated by the arrow m. The charger 16 charges the photoconductive drum 14. The exposure scanning head 17 radiates exposure light towards the photoconductive drum 14 based on image data to form an electrostatic latent image on the photoconductive drum 14.

The developer 18 feeds a toner for the electrostatic latent image on the photoconductive drum 14. The developer 18 feeds non-erasable black toner for the electrostatic latent image on the photoconductive drum 14 with a two-component developing agent composed of the mixture of non-erasable black toner serving as a non-erasable material which will not be thermally erased and a magnetic carrier. A transfer device 20 transfers the toner image formed on the photoconductive drum 14 to the sheet P. The charger 16, the exposure scanning head 17, the developer 18 and the transfer device 20 constitute the first image forming section. The non-erasable printer section 11*a* may also be a color printer instead of a monochrome printer.

The MFP 10 includes a heater 24 along the conveyance path 23. If the MFP 10 is in the printing mode, the heater 24 functions as a fixing apparatus. If the MFP 10 is in the erasing mode, the heater 24 functions as an erasing apparatus. In the printing mode, the heater 24 heats and pressurizes the sheet P at a fixing temperature to fix the black toner image formed on the sheet P. In the erasing mode, the heater 24 heats and pressurizes the sheet P at an erasing temperature higher than the fixing temperature to erase the erasable image formed on the sheet P.

The CPU 120 controls the set temperature of the heater 24 according to whether the MFP 10 is in the printing mode or the erasing mode so as to change the set temperature. The CPU 120 may control the moving speed of the sheet P through the heater 24 according to whether the MFP 10 is in the printing mode or the erasing mode so as to change the moving speed.

The erasing printer section 11*b* is, for example, an inkjet type printer which forms an image with an erasable ink, that is, an erasable material that will be thermally erased. The erasing printer section 11*b*, which is not limited to be an inkjet type printer, may further be an electrophotographic printer for printing with an erasable toner. No limitation is given to the color or number of the erasable materials of the erasing printer section.

The erasing printer section 11*b* includes a first erasing printer section 31 and a second erasing printer section 32. The first erasing printer section 31 has a first ink cartridge 31*a* for storing, for example, red erasable ink and a first printing head 31*b*. The second erasing printer section 32 has a second ink cartridge 32*a* for storing, for example, blue erasable ink and a second printing head 32*b*.

The color erasing printer section 11*b* includes a first platen roller 33 or a second platen roller 34 at a position opposite to the first erasing printer section 31 or the second erasing printer section 32 through the conveyance path 23.

The erasable ink, for example, will be erased if heated at a given temperature. No specific limitation is given to the color or specific material of the erasable ink as long as it will be thermally erased. The erasable ink is configured by properly combining a color generation compound such as leuko dye with a color developing agent, an erasing agent and a color changing temperature adjusting agent.

When the temperature of the color-erasable ink is below an erasing temperature, the color generation compound generates a color due to the effect of the color developing agent, thus making colors recognizable. When the erasable ink is heated above a specific erasing temperature, the color generation compound and the color developing agent are dissociated, thus making colors unrecognizable. The erasing temperature of the erasable ink is adjusted by designing materials of the color generation compound, the color developing agent, the color erasing agent and the color changing temperature adjusting agent. The erasable ink is erased at a temperature which is about, for example, 10 degrees centigrade above the fixing temperature of the non-erasable toner. For example, the erasing printer section 11*b* may change the erasing temperature by using red erasable ink and blue erasable ink.

Figure 4:
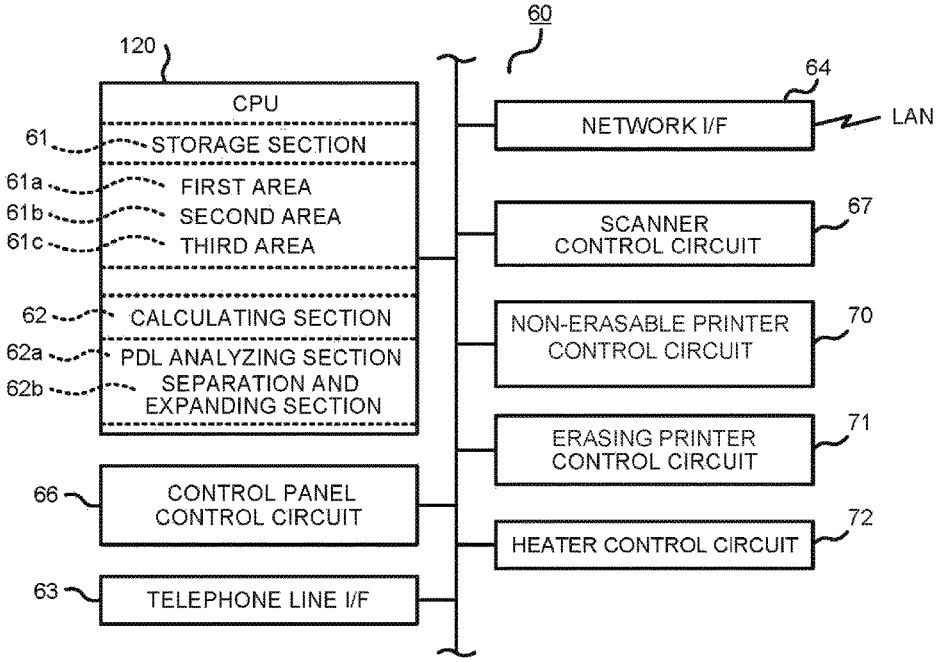
FIG. 4 is a block diagram illustrating a control system of the MFP, according to the first embodiment.

The control system 60 of the MFP 10 taking an image printing control and an image color erasing control as the main job is illustrated below with reference to the block diagram shown in FIG. 4. The control system 60 includes a CPU 120, which controls the whole MFP 10, a storage section 61, and a calculating section 62. The control system 60 also includes a telephone line interface (I/F) 63 and a network I/F 64. The control system 60 further includes a control panel control circuit 66, a scanner control circuit 67, a non-erasable printer control circuit 70, an erasing printer control circuit 71 and a heater control circuit 72.

By executing the applications stored in the storage section 61, the CPU 120 realizes an image forming processing function using the non-erasable printer section 11*a* and an image forming processing function or image erasing processing function using the erasing printer section 11*b*. The storage section 61 includes a ROM (Read Only Memory) that stores applications for the control methods and control data for realizing basic actions of an image forming processing or an image erasing processing. The storage section 61 further includes a working memory for temporarily storing a printing condition for determining attributes of the print data created by the PC 101.

The storage section 61 stores the print data having attributes that are determined according to the printing condition. The storage section 61 includes a first area 61*a* serving as a non-erasable image storage section and a second area 61*b* and a third area 61*c* serving as erasable image storage sections.

The calculating section 62 includes a PDL (Page Description Language) analyzing section 62*a* for analyzing the object of the print data created by the PC 101. The calculating section 62 includes a separation and expanding section 62*b* for determining attributes of the object analyzed by the PDL analyzing section 62*a* and storing the expanded image data in the storage section 61. The CPU 120 stores the image data expanded by the separation and expanding section 62*b* in the first area 61*a*, the second area 61*b* and the third area 61*c* of the storage section 61, based on the determined attributes.

For example, the PDL analyzing section 62*a* analyzes attribute information by each object of the print data which is sent to the MFP 10 after being created by the PC 101.

The separation and expanding section 62*b* determines the analyzed print data by each object and separates the print data into first attribute data and second attribute data. The separation and expanding section 62*b* determines the print data created by the PC 101, that is, the image data not corresponding to the printing condition set on the printing condition screen 104 of the PC 101, to be first attribute data and stores the first attribute data in the first area 61*a*. For example, the separation and expanding section 62*b* determines monochromatic text data as first attribute data.

The separation and expanding section 62*b* determines the additional data in the print data created by the PC 101, that is, the image data corresponding to the printing condition set on the printing condition screen 104 of the PC 101, to be second attribute data and stores the second attribute data in the second area 61*b* and the third area 61*c*. Additional data includes, for example, decorative words (mark, underline, boldface, italic, hatch), a graph and an annotation.

The separation and expanding section 62*b* further determines whether or not the second attribute data is red or blue according to the printing condition.

The separation and expanding section 62*b* separates the red second attribute data from the print data created by the PC 101 and stores the red second attribute data in, for example, the second area 61*b* of the storage section 61 so that the second attribute data can be printed by the first erasing printer section 31. The separation and expanding section 62*b* separates the blue second attribute data from the print data created by the PC 101 and stores the blue second attribute data in, for example, the third area 61*c* of the storage section 61 so that the second attribute data can be printed by the second erasing printer section 32.

The telephone line interface (I/F) 63 communicates with a fax machine. The network I/F 64 communicates with a user terminal or another MFP. The control panel control circuit 66 controls an operation panel 50*a* and a display 50*b*. The scanner control circuit 67 controls a scanner section 12. The non-erasable printer control circuit 70 controls the non-erasable printer section 11*a*. The erasing printer control circuit 71 controls the erasing printer section 11*b*.

Figure 5:
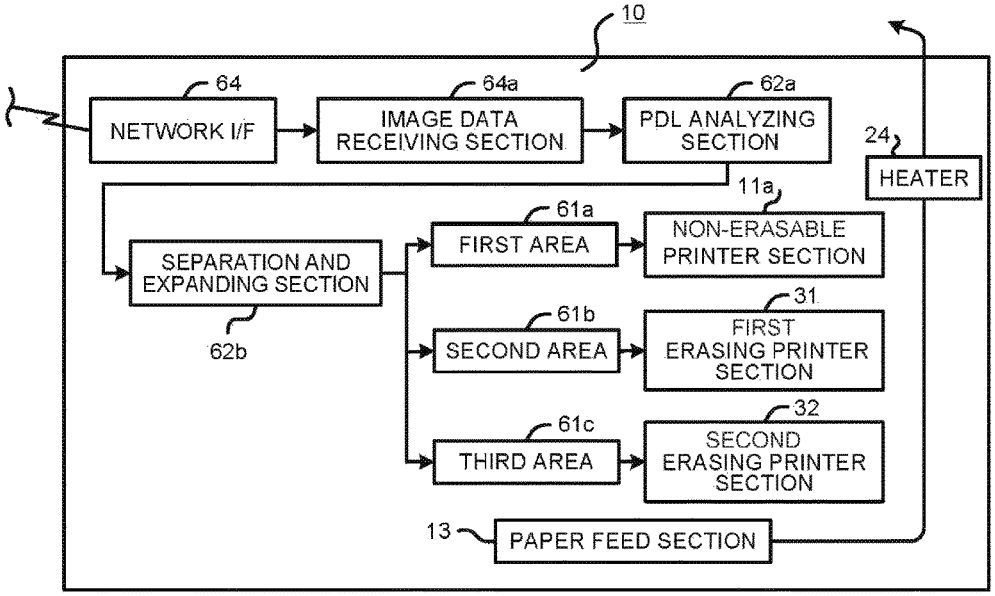
FIG. 5 is a function block diagram illustrating functions of the MFP, according to the first embodiment.

The printing function of the MFP 10 is described with reference to the functional block diagram shown in FIG. 5. The MFP 10 includes an image data receiving section 64*a* for receiving print data from the network I/F 64, a PDL analyzing section 62*a*, a separation and expanding section 62*b*, a first area 61*a*, a second area 61*b* and a third area 61*c*. The MFP 10 also includes a non-erasable printer section 11*a*, a first erasing printer section 31, a second erasing printer section 32, a paper feed section 13, and a heater 24.

With the aforementioned functions, the MFP 10, when in the printing mode, prints image data on the sheet P fed from the paper feed section 13 using the non-erasable printer section 11*a*, the first erasing printer section 31 or the second erasing printer section 32. When in the erasing mode, the MFP 10 heats, using the heater 24, the sheet P fed from the paper feed section 13 at a temperature higher than an erasing temperature so as to erase the erasable image formed on the sheet P.

After receiving print data from the PC 101, the MFP 10 starts to print. The PC 101 instructs, using an application for the creation of files, a setting such as 'print graphs in red color and underlines in blue color' for a created file as a piece of printing attribute information. The MFP 10 enters the printing mode due to the starting of the print job, and the heater control circuit 72 sets the temperature of the heater 24 to be the fixing temperature of a black toner.

Figure 6:
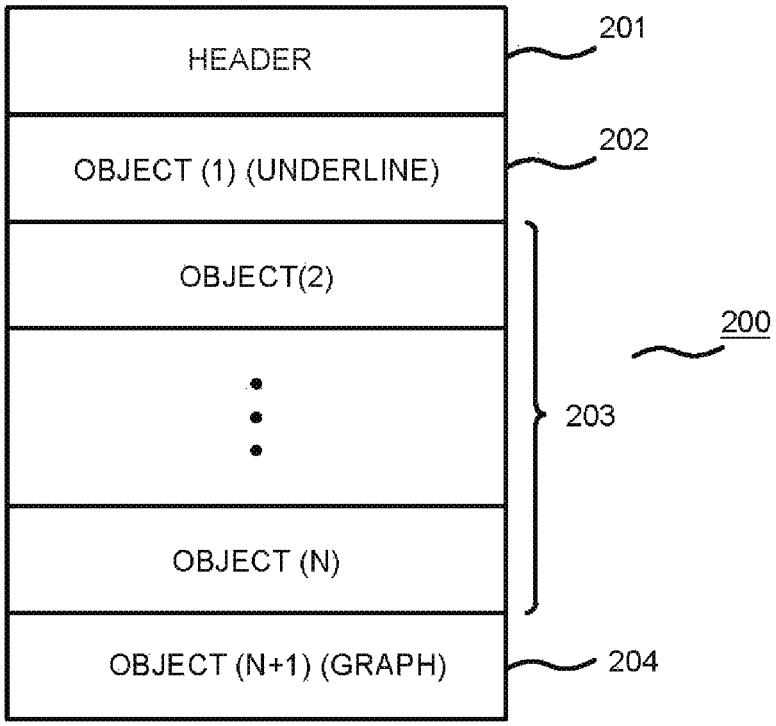
FIG. 6 is a diagram illustrating a structure of print data, according to the first embodiment.

The MFP 10 analyzes objects using the PDL analyzing section 62*a*. As shown in FIG. 6, the PDL analyzing section 62*a* analyses print data 200 to decompose the print data into a header 201, an object (1) (underline) 202, object (2)-object (N) 203 and an object (N+1) 204. The content related to a print job is described in the header 201, and image data is described in the objects.

Figure 7:
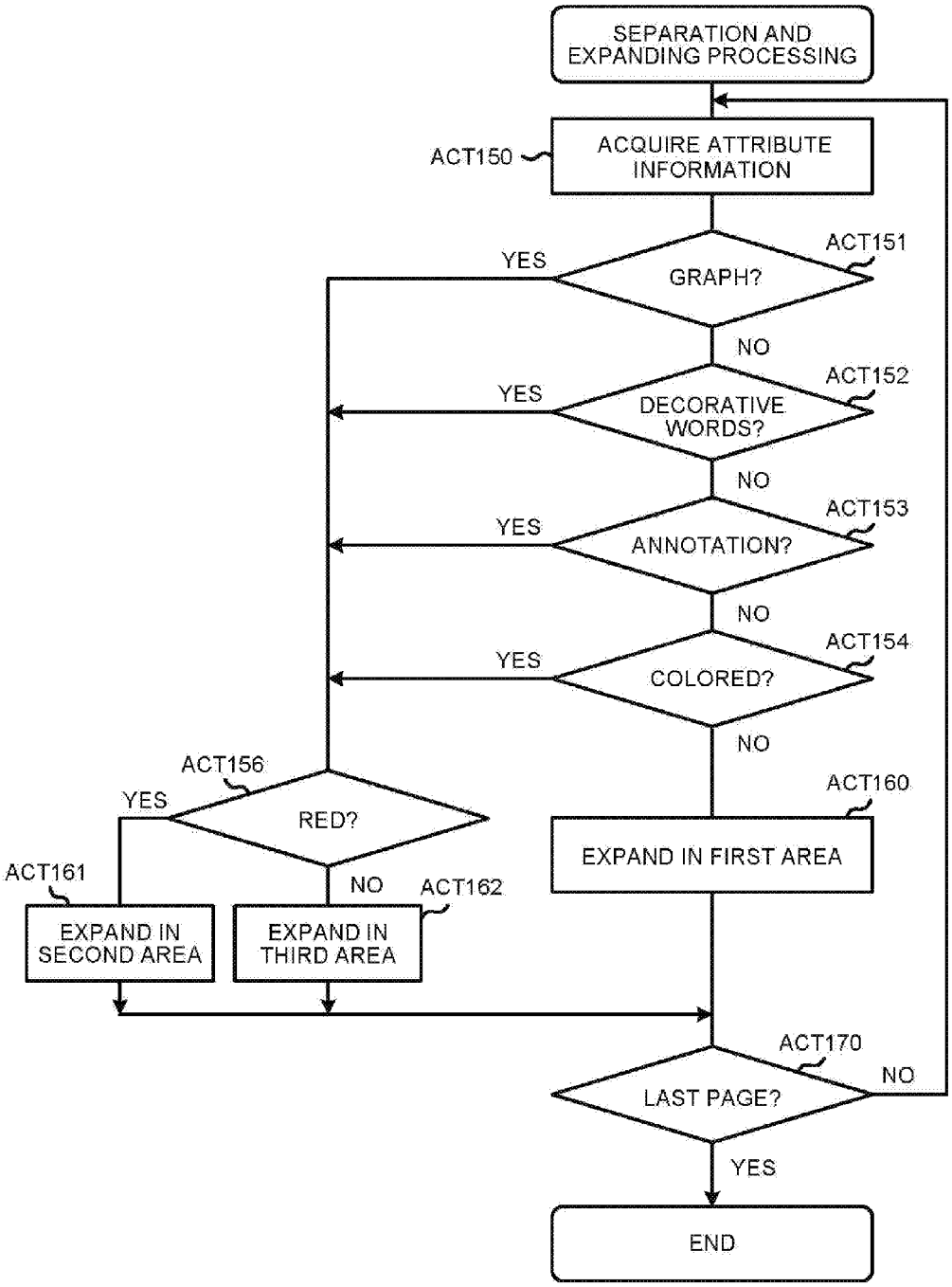
FIG. 7 is a flowchart illustrating a separation and expanding processing of print data, according to the first embodiment.

The separation and expanding section 62*b* of the MFP 10 separates and expands the objects of the print data 200 according to the flowchart of FIG. 7 and stores the separated and expanded objects in the first area 61*a*, the second area 61*b* or the third area 61*c* of the storage section 61. The separation and expanding section 62*b* acquires the attribute information analyzed by the PDL analyzing section 62*a* for each object (ACT 150).

For each expanded object of the print data 200, the separation and expanding section 62*b* determines whether or not the object acquired is a graph (ACT151). If the object is not a graph (No in ACT 151), the flow proceeds to ACT 152 to determine whether or not the object is decorative words. If it is determined in ACT 152 that the object is not decorative words (No in ACT 152), the flow proceeds to ACT 153 to determine whether or not the object is an annotation. If it is determined in ACT 153 that the object is not an annotation (No in ACT 153), the flow proceeds to ACT 154 to determine whether or not the object is colored. If it is determined in ACT 154 that the object is not colorized (No in ACT 154), then it is determined that the object is monochromatic text data, the flow proceeds to ACT 160 to store the expanded image data in the first area 61*a* as first attribute data. The separation and expanding section 62*b* determines that the objects (2)-(N) 203 of the print data 200 are text data and stores the image data of the objects in the first area 61*a*.

If the object is not first attribute data, that is, the acquired object is a graph (Yes in ACT 151) or decorative words (Yes in ACT 152) or annotation (Yes in ACT 153) or is colored (Yes in ACT 154), then it is determined that the object is second attribute data, then the flow proceeds to ACT 156.

The separation and expanding section 62*b* determines whether or not the object of second attribute data is set to be red. If the object is set to be red (Yes in ACT 156) on the printing condition screen 104 of the PC 101, the separation and expanding section 62*b* proceeds to ACT 161 to store the expanded image data in the second area 61*b*. If the object is set to be blue (No in ACT 156) on the printing condition screen 104 of the PC 101, the separation and expanding section 62*b* proceeds to ACT 162 to store the expanded image data in the third area 61*c*. The separation and expanding section 62*b* determines that the object N+1 (graph) 204 of the print data 200 is to be printed as red additional data and that the object (1) (underline) 202 of the print data 200 is to be printed as blue additional data.

When reaching the last page (Yes in ACT 170), the separation and expanding section 62*b* ends the separation and expanding processing of the print data 200. In the flowchart of FIG. 7, the determination items change according to the printing condition set on the printing condition screen 104 of the PC 101.

Figure 8:
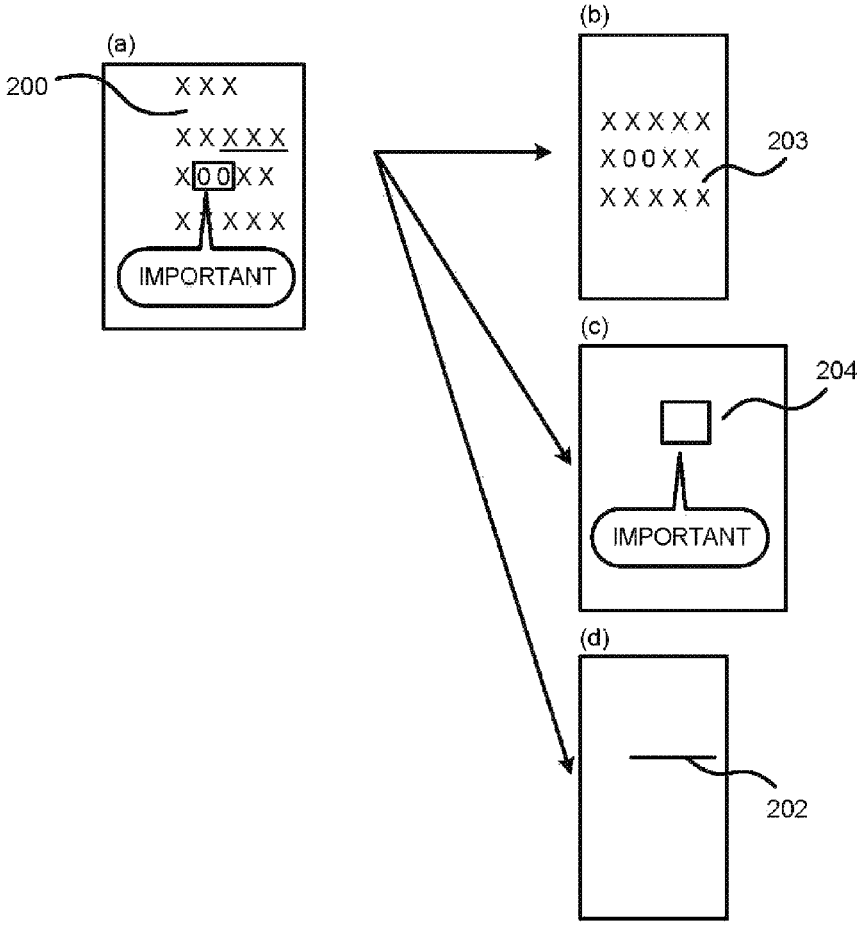
FIG. 8 is a diagram illustrating the separation and expanding diagram of print data objects, according to the first embodiment.

FIG. 8 is a diagram illustrating the separation and expanding of the print data 200. The print data 200 shown in FIG. 8(*a*) is expanded and separated into the objects (2)-(N) 203 shown in FIG. 8 (*b*), the object (N+1) (graph) 204 shown in FIG. 8 (*c*) and the object (1) (underline) 202 shown in FIG. 8 (*d*).

The MFP 10 prints the objects (2)-(N) 203 stored in the first area 61*a* with non-erasable black toner, the object (N+1) (graph) 204 stored in the second area 61*b* with red erasable ink, and the object (1) (underline) 202 stored in the third area 61*c* with blue erasable ink.

The MFP 10 forms, on the sheet P conveyed by the conveyance path 23, black toner images corresponding to the objects 2N 203 using the non-erasable printer section 11*a*. The MFP 10 heats, using the heater 24, and fixes the black toner images on the sheet P. Next, the MFP 10 prints, on the sheet P conveyed by the conveyance path 23, the image of the object N+1 (graph) 204 using the first erasing printer section 31. Sequentially, the MFP 10 prints, on the sheet P conveyed by the conveyance path 23, the image of the object 1 (underline) 202 using the second erasing printer section 32. When conveyed on the conveyance path 23 of the MFP 10, the sheet P is printed with images corresponding to the print data 200 by the non-erasable printer section 11*a*, the first erasing printer section 31 and the second erasing printer section 32.

Figure 9:
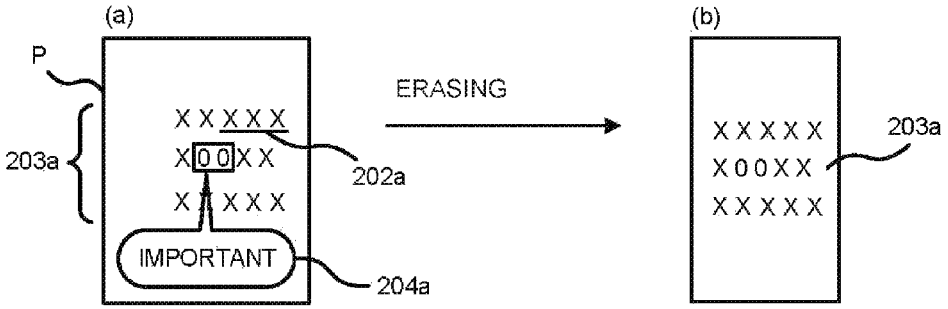
FIG. 9 is a diagram illustrating an image transition, according to the first embodiment 1.

FIG. 9(*a*) is a diagram illustrating an image printed on the sheet P. A file 203*a* formed with non-erasable black toner, a graph 204*a* formed with red erasable ink and an underline 202*a* formed with blue erasable ink are printed on the sheet P. The user or the system manager may set a printing condition for the use of erasable ink on the printing condition screen 104 of the PC 101 freely.

The graph 204*a* and the underline 202*a* printed in the image on the sheet P are erasable. The graph 204*a* and the underline 202*a*, if so desired, can be erased by the user using the MFP 10. The user places the printed sheet P in the paper feed section 13 and switches the MFP 10 to be in an erasing mode. When in the color erasing mode, the heater control circuit 72 sets the temperature of the heater 24 to be an erasing temperature.

After starting an erasing processing, the MFP 10 heats the sheet P acquired from the paper feed section 13 and conveyed in the conveyance path 23 at an erasing temperature using the heater 24 and then discharges the sheet P to the paper discharge section 22. By heating the sheet P at the erasing temperature, the graph 204*a* and the underline 202*a* printed on the sheet P are erased. As shown in FIG. 9 (*b*), needless graph 204*a* and underline 202*a* are erased so that only the file 203*a* on the sheet P is readable.

The MFP 10 may be used for any purpose, for example, to print the grids of a form with an erasable material and erase the grids after necessary items are recorded, but is not limited to be used for a specific purpose.

In accordance with the first embodiment, the MFP 10 includes a non-erasable printer section 11*a* and an erasing printer section 11*b*. The MFP 10 prints a file 203*a* formed with non-erasable black toner, a graph 204*a* formed with red erasable ink and an underline 202*a* formed with blue erasable ink on the sheet P. Unwanted graph 204*a* and underline 202*a* are erased after being printed so that only the header 201 and the file 203*a* formed on the sheet P with black toner are readable.

According to embodiment 1, the printed images including an image printed with non-erasable black toner and an image printed with red and blue erasable ink needed by the user are acquired during a printing processing. By changing colors of the erasable material and the non-erasable material, the printed images can be read easily. The erasable material can be erased after a print job so that only the image formed with the non-erasable material can be read, thereby acquiring a printed image which can be read easily and used effectively according to a use purpose.

Second Embodiment

The image forming apparatus of a second embodiment is described below with reference to accompanying drawings of FIG. 10-17. In the second embodiment, similar to the first embodiment, the color erasing printer section is further provided with an electrophotographic color erasing printer. The configuration of the second embodiment that is the same as that described in embodiment 1 is denoted by the same reference numbers and is therefore not described herein in detail.

Figure 10:
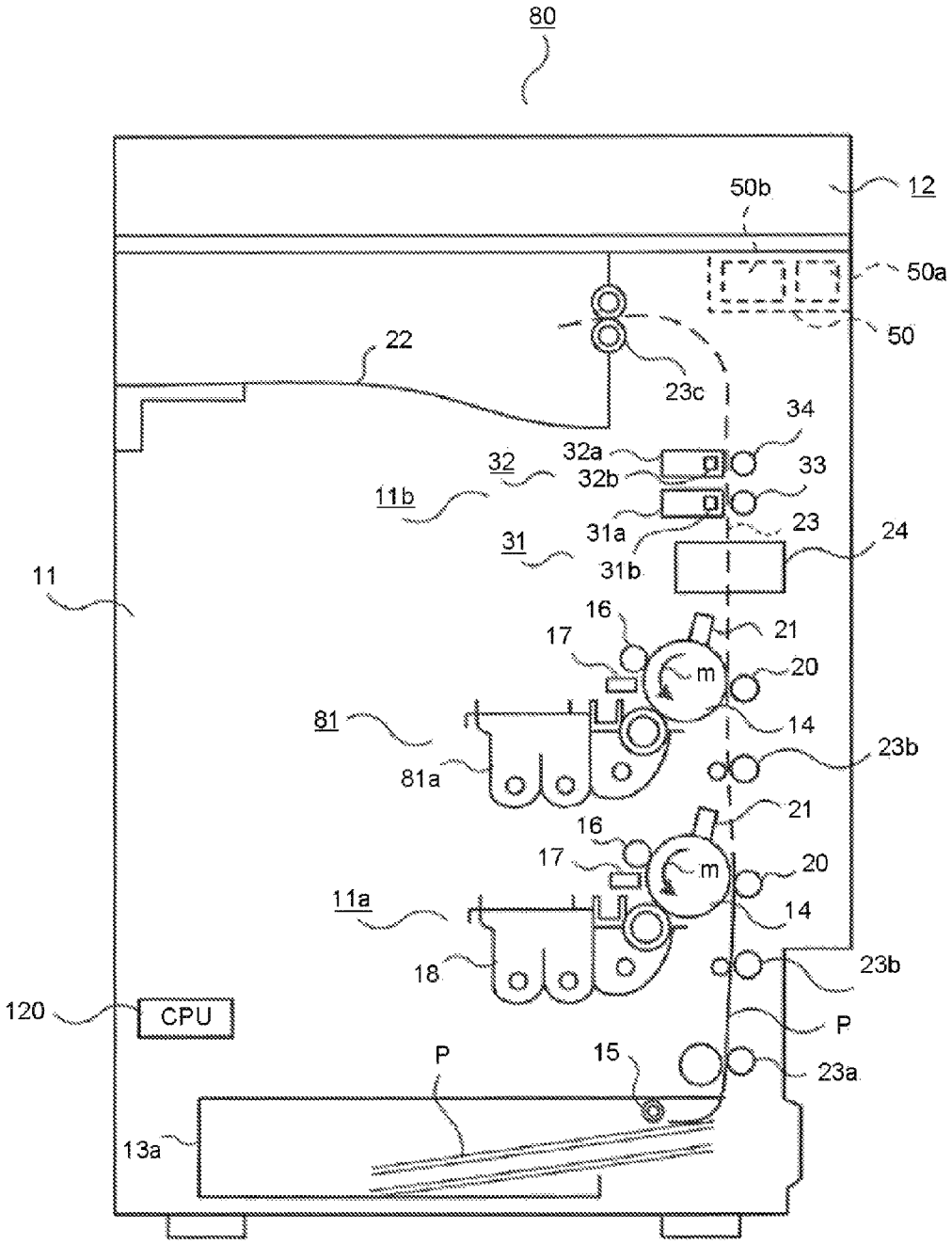
FIG. 10 is a diagram illustrating an MFP, according to a second embodiment.

As shown in FIG. 10, the MFP 80 includes, along the conveyance path 23, a third erasing printer section 81 of electrophotographic type serving as an erasable image forming apparatus forming an image with erasable black toner at the downstream side of the non-erasable printer section 11*a*. The third erasing printer section 81 is the same as the non-erasable printer section 11*a* except that the toner used by the developer 81*a* is different from that used by the non-erasable printer section 11*a*.

The erasable black toner is erased, for example, when heated at an erasing temperature. In the second embodiment, the erasing temperature of the erasable black toner is set to be higher than that of the red erasable ink of the first erasing printer section 31 and the blue erasable ink of the second erasing printer section 32. The fixing temperature of the erasable black toner is, for example, the same as that of the non-erasable black toner. The erasable black toner may be erased when heated at a relatively high temperature, such as 20 degrees centigrade above the fixing temperature.

When in the erasing mode, the heater control circuit 72 of the MFP 80 may set the erasing temperature of the heater 24 to be equal to the erasing temperature of ink or equal to the erasing temperature of toner (which is higher than the erasing temperature of ink). The erasing temperature of ink refers to a temperature at which the red and blue erasable inks are erased. The erasing temperature of the toner refers to a temperature at which the erasable black toner is erased.

Figure 11:
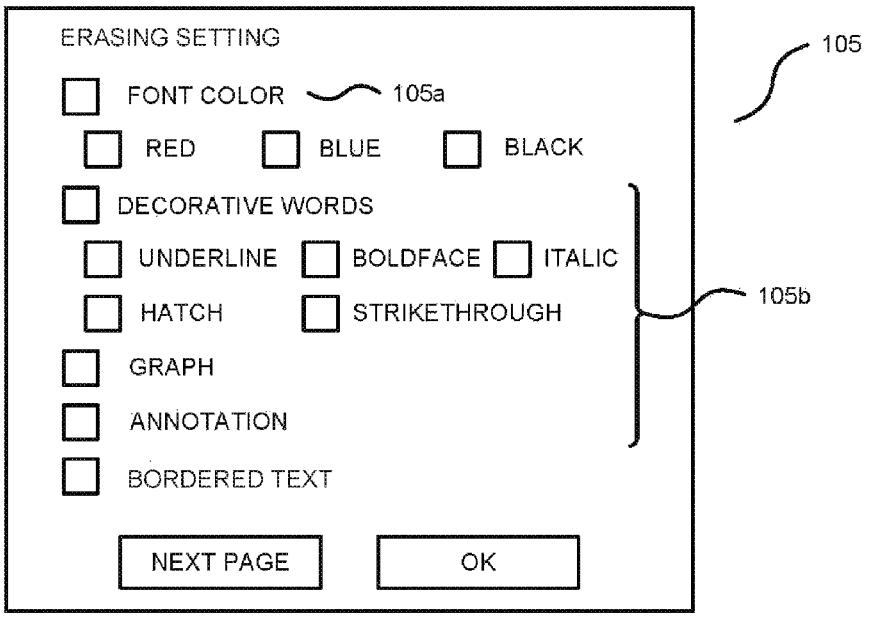
FIG. 11 is a diagram illustrating the printing condition screen of the MFP of a PC, according to the second embodiment.

The PC 101 includes the printing condition screen 105 shown in FIG. 11 for the printing setting of the MFP 80. The color selection condition 105*a* of the printing condition screen 105 sets red, blue and black colors. The image designation condition 105*b* sets decorative words, a graph, an annotation and a bordered text. Further, the printing condition screen may be displayed on the operation screen of the MFP 10 directly and set using the operation panel of the MFP 10.

Figure 12:
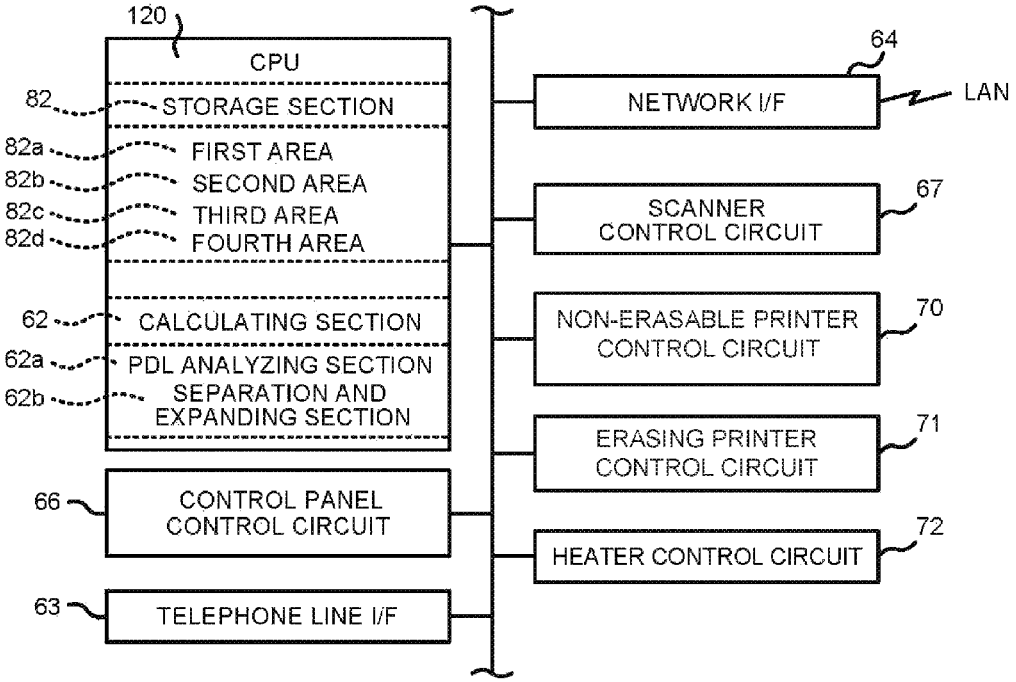
FIG. 12 is a block diagram illustrating a control system of the MFP, according to the second embodiment.

As shown in FIG. 12, the storage section 82 of the control system 83 of the MFP 80 includes a first area 82*a* serving as a non-erasable storage section, a second area 82*b* serving as an erasable storage section, a third area 82*c* and a fourth area 82*d*. The data printed by the non-erasable printer section 11*a* is stored in the first area 82*a*. The data printed by the first erasing printer section 31 is stored in the second area 82*b*. The data printed by the second erasing printer section 32 is stored in the third area 82*c*. The data printed by the third erasing printer section 81 is stored in the fourth area 82*d*.

Figure 13:
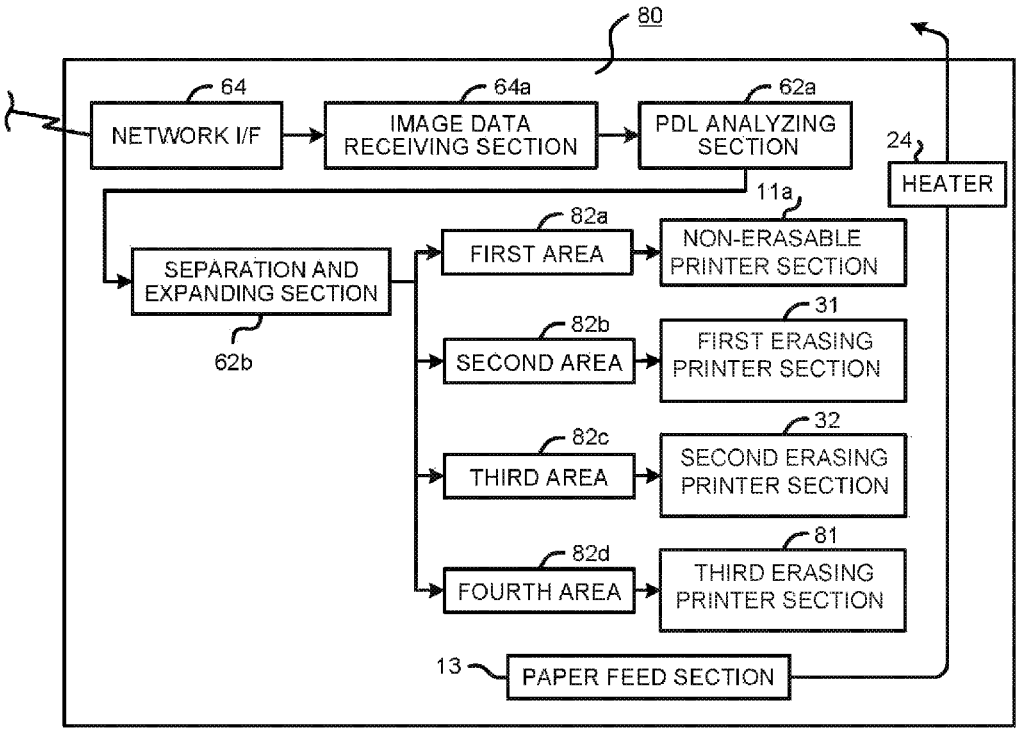
FIG. 13 is a block diagram illustrating functions of the MFP, according to the second embodiment.

As shown in the functional block diagram of FIG. 13, the MFP 80 includes a first area 82*a*, a second area 82*b*, a third area 82*c*, a fourth area 82*d*, a non-erasable printer section 11*a*, a first erasing printer section 31, a second erasing printer section 32 and a third erasing printer section 81.

With the aforementioned functions, the MFP 80, when in a printing mode, prints image data on the sheet P fed from the paper feed section 13 using the non-erasable printer section 11*a*, the first erasing printer section 31, the second erasing printer section 32 or the third erasing printer section 81.

After receiving print data from the PC 101, the MFP 80 starts to print. The PC 101 instructs, using an application for the creation of files, a setting such as 'add a border at a specified file position, print graphs in red color and underlines in blue color' for a created file including printing attribute information. The MFP 80 enters the printing mode due to the starting of the print job, and the heater control circuit 72 sets the temperature of the heater 24 to be the fixing temperature of a black toner.

Figure 14:
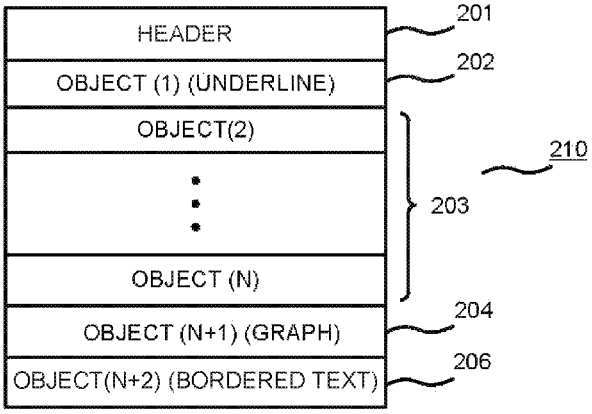
FIG. 14 is a diagram illustrating a structure of print data, according to the second embodiment.

The MFP 80 analyzes objects of the print data using the PDL analyzing section 62*a*. As shown in FIG. 14, the PDL analyzing section 62*a* analyzes print data 210 to separates the print data into a header 201, an object (1) 202, objects (2)-(N) 203, an object (N+1) (graph) 204 and an object (N+2) (bordered text) 206. The content related to a print job is described in the header 201, and image data is described in the objects.

Figure 15:
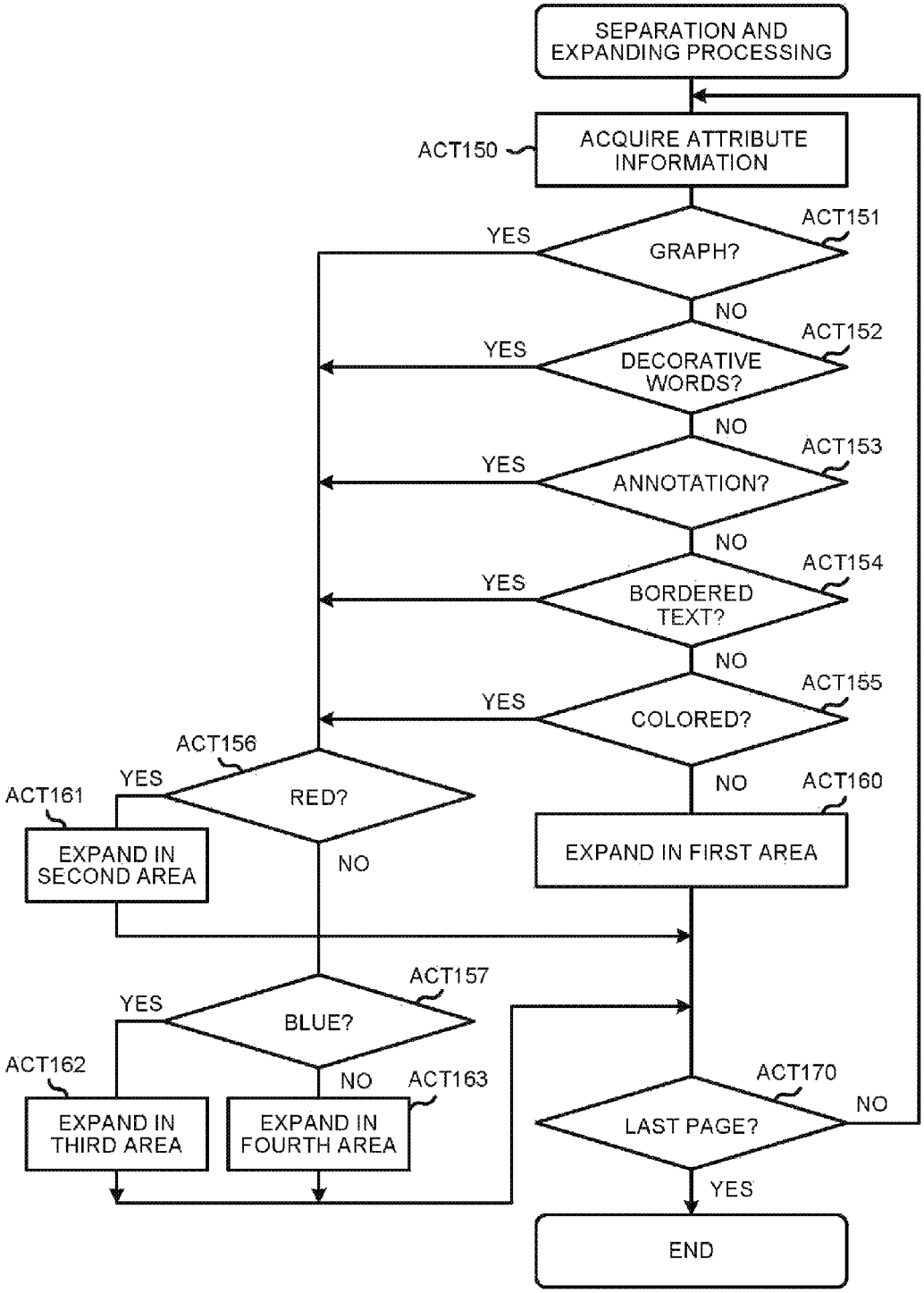
FIG. 15 is a flowchart illustrating a separation and expanding processing of print data, according to the second embodiment.

The separation and expanding section 62*b* of the MFP 80 separates and expands the objects of the print data 210 according to the flowchart of FIG. 15 and stores the separated and expanded objects in the first area 82*a*, the second area 82*b*, the third area 82*c* or the fourth area 82*d* of the storage section 82. The flowchart shown in FIG. 15 of embodiment 2 is different from that shown in FIG. 7 of embodiment 1 in that a determination on whether or not the print data is a bordered text should be made if the print data is file data.

If the result of ACT 153 described in the first embodiment is No—that is, the object is text data—then in the second embodiment, it is determined in ACT 154 whether or not the object is a bordered text. Moreover, when the object is not a bordered text (No in ACT 154), it is determined in ACT 155 whether or not the object is colored. If it is determined in ACT 155 that the object is not colored (No in ACT 155), then it is determined that the object is monochromatic text data, the flow proceeds to ACT 160 to store the image data in the first area 82*a* as first attribute data.

If the object is a graph, decorative words, an annotation, a bordered text or is colored (Yes in ACT152, ACT153, ACT154 or ACT155), then it is determined that the object is second attribute data, consequentially, the flow proceeds to ACT 156 to determine whether or not the object of the second attribute date is red. In ACT 161, the object (N+1) (graph) 204 is expanded into image data and is then stored in the second area 82*b*. If the object of the second attribute data is not red (No in ACT 156), the flow proceeds to ACT 157 to determine whether or not the object of the second attribute data is blue. In ACT 162, the object 1 (underline) 202 is expanded into image data and is then stored in the third area 82*c*. If the object of the second attribute date is not blue (No in ACT 157), the object (N+2) (bordered text) 206 is expanded into image data and is then stored in the fourth area 82*d* in ACT163.

Figure 16:
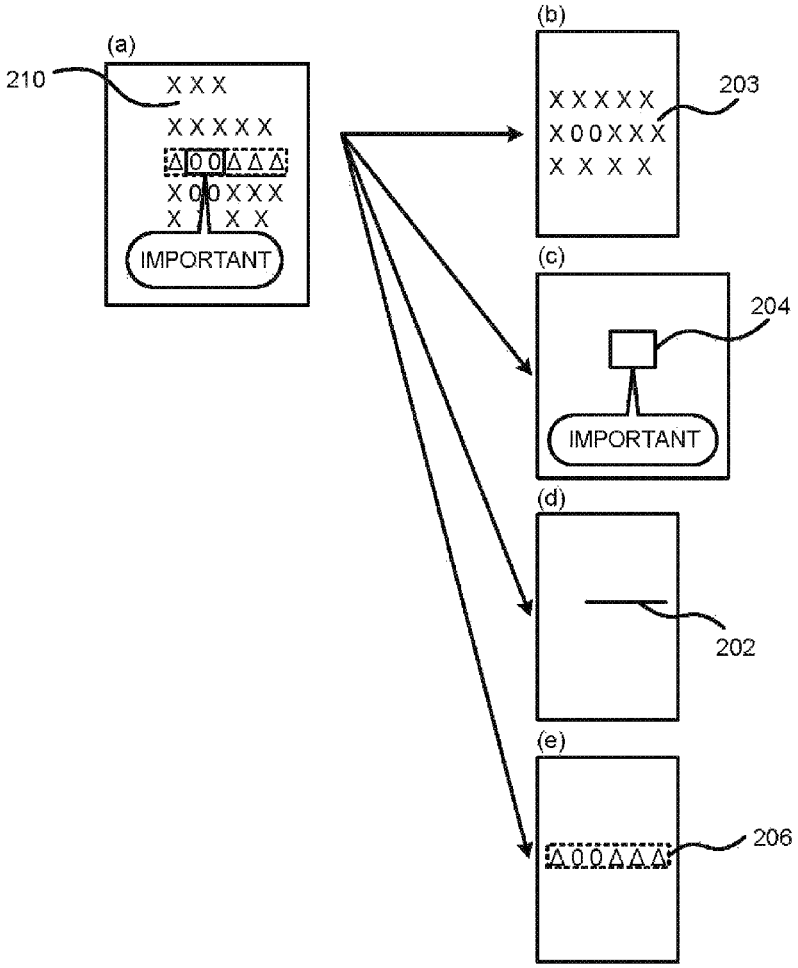
FIG. 16 is a diagram illustrating the separation and expanding diagram of print data objects, according to the second embodiment.

FIG. 16 is a diagram illustrating the separation and expanding of the print data 210. The print data 210 shown in FIG. 16(*a*) is expanded and separated into the objects (2)-(N) 203 shown in FIG. 16(*b*), the object (N+1) (graph) 204 shown in FIG. 16(*c*), the object (1) (underline) 202 shown in FIG. 16(*d*) and the object (N+2) (bordered text) 206 shown in FIG. 16 (*e*).

The MFP 80 prints images of the objects (2)-(N) 203 stored in the first area 82*a* with non-erasable black toner. The MFP 80 prints the image of the object (N+1) (graph) 204 stored in the second area 82*b* with red erasable ink, the image of the object (1) (underline) 202 stored in the third area 82*c* with blue erasable ink, and the image of the object (N+2) (bordered text) 206 stored in the fourth area 82*d* with erasable black toner.

The MFP 80 forms, on the sheet P conveyed by the conveyance path 23, non-erasable black toner images corresponding to the objects (2)-(N) 203 using the non-erasable printer section 11*a*. The MFP 80 forms, on the sheet P on which the non-erasable black toner image is formed, an erasable black toner image corresponding to the object (N+2) (bordered text) 206 using the third erasing printer section 81. The MFP 80 heats, using the heater 24, and fixes the non-erasable black toner image and the erasable black toner image on the sheet P.

Next, the MFP 80 prints, on the sheet P conveyed by the conveyance path 23, the object (N+1) (graph) 204 of the image data using the first non-erasable printer section 31. Then, the MFP 80 prints, on the sheet P conveyed by the conveyance path 23, the object (1) (underline) 202 of the image data using the second erasing printer section 32. When conveyed on the conveyance path 23 of the MFP 80, the sheet P is printed with images corresponding to the print data 210 by the non-erasable printer section 11*a*, the third erasing printer section 81, the first erasing printer section 31 and the second erasing printer section 32.

Figure 17:
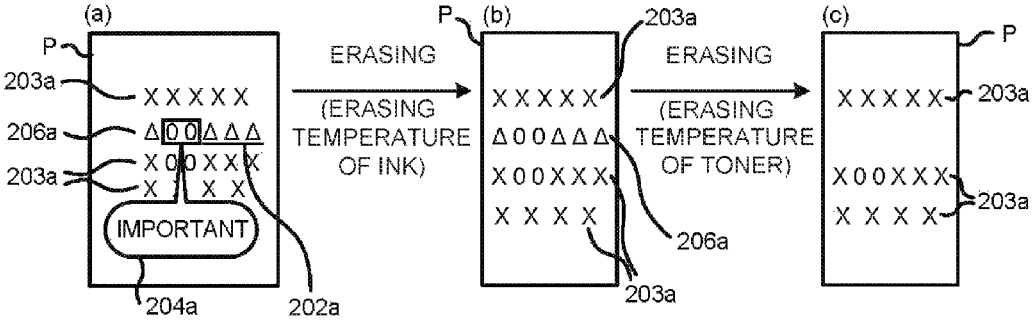
FIG. 17 is a diagram illustrating an image transition, according to the second embodiment.

FIG. 17(*a*) is a diagram illustrating an image printed on the sheet P. A file 203*a* formed with non-erasable black toner, a bordered text 206*a* formed with erasable black toner, a graph 204*a* formed with red erasable ink and an underline 202*a* formed with blue erasable ink are printed on the sheet P.

The bordered text 206*a*, the graph 204*a* and the underline 202*a* printed in the image on the sheet P are erasable. As the erasing temperature of the erasable black toner, the red ink and the blue ink are different, the graph 204*a* and the underline 202*a* may be erased while the bordered text 206*a* is not erased.

The graph 204*a* and the underline 202*a*, if determined to be unnecessary, can be erased by switching the MFP 80 to an erasing mode in which the heater 24 is set at the erasing temperature of ink. As shown in FIG. 17 (*b*), needless graph 204*a* and underline 202*a* are erased so that only the header 201, the file 203*a* and the bordered text 206*a* on the sheet P are readable.

The bordered text 206*a*, if needless, can be erased by switching the MFP 80 to the erasing mode in which the heater 24 is set at the erasing temperature of toner. As shown in FIG. 17 (*c*), the needless bordered text 206*a* is erased so that only the header 201 and the file 203*a* on the sheet P are readable. And the graph 204*a*, the underline 202*a* and the bordered text 206*a* on the sheet P can be erased synchronously after a print job is finished.

No limitation is given to the use of the MFP 80. For example, it may be set that the files created by the PC 101 are all bordered text which are printed with erasable black toner, and that decorative words are printed with erasable ink. If files are all printed with erasable black toner, needless files may be erased after needless decorative words on the sheet are erased. Alternatively, all files and decorative words may be erased so as to reuse the sheet.

In accordance with the second embodiment, in addition to the erasing printer section 11*b*, the first erasing printer section 31 and the second erasing printer section 32, the MFP 80 further includes a third erasing printer section 81. The erasing temperature of the erasable black toner of the third erasing printer section 81 is set to be higher than the erasing temperature of the erasable ink. The MFP 80 prints a file 203*a* with non-erasable black toner, a graph 204*a* with red erasable ink, an underline 202*a* with blue erasable ink and a bordered text 206*a* with erasable black toner on the sheet P. Needless graph 204*a*, underline 202*a* and bordered text 206*a* may be erased after a print job.

Similar to the first embodiment, in the second embodiment, the printed image needed by the user may be acquired during the printing processing and the erasable printed image is erased after the print job so as to acquire the printed image that can be read easily and used effectively according to a desired purpose. Moreover, erasable printed images may be erased at the erasing temperature of each erasable material so as to acquire the printed image needed by the user.

According to at least one of the embodiments above, parts of images are erased after the printed images needed by the user are acquired. Thus, the printed image that can be read easily and used effectively are acquired according to a desired purpose.

The image forming apparatus described in at least one of the aforementioned embodiments is not limited to have an image printing function and an image erasing function. For example, the image forming apparatus, if provided with a function of printing with a non-erasable material and a function of printing with an erasable material, may have no erasing function. If the image forming apparatus only has a printing function, then another image erasing apparatus different from the image forming apparatus is used to erase the image formed with an erasable material.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a first image forming unit configured to perform image forming on a medium with a first erasable material having a first erasing temperature;

a second image forming unit configured to perform image forming on the medium with a second erasable material having a second erasing temperature that is different from the first erasing temperature;

a heater configured to heat a sheet to erase an image formed thereon; and a controller configured to set a temperature of the heater to the first erasing temperature or the second erasing temperature during an erasing mode, and control the first image forming unit to print a first type of image on the medium with the first erasable material and control the second image forming unit to print a second type of image on the medium with the second erasable material, based on selections made on an input interface to print the first type of image with a color of the first erasable material and the second type of image with a color of the second erasable material, during a printing mode, wherein the first type of image is one of decorative characters, annotations, and bordered characters, and the second type of image is different from the first type of image.

2. The image forming apparatus according to claim 1, wherein the color of the first erasable material is different from the color of the second erasable material.

3. The image forming apparatus according to claim 1, wherein the first and second types of image are printed on a same surface of the medium.

4. The image forming apparatus according to claim 1, further comprising:

a third image forming unit configured to perform image forming on the medium with a non-erasable material, wherein the controller is further configured to control the third image forming unit to print a third type of image on the medium with the non-erasable material.

5. The image forming apparatus according to claim 4, wherein the first, second, and third types of image are printed on a same surface of the medium.

6. The image forming apparatus according to claim 4, wherein the color of the second erasable material is the same as a color of the non-erasable material.

7. The image forming apparatus according to claim 6, wherein the color of the second erasable material is black.

8. The image forming apparatus according to claim 1, further comprising:

an operation panel that displays the input interface and through which the selections are made.

9. The image forming apparatus according to claim 1, wherein the selections are made using a computing device connected to the image forming apparatus over a network.

10. The image forming apparatus according to claim 1, wherein the first image forming unit is an inkjet-type printer, and the second image forming unit is an inkjet-type printer.

11. The image forming apparatus according to claim 1, wherein the first image forming unit is an inkjet-type printer, and the second image forming unit is an electrophotographic-type printer.

12. The image forming apparatus according to claim 1, wherein the input interface includes a different setting screen for each page of a document, and the selections are made on a setting screen for a page of the document.

* * * * *